United States Patent [19]

Borbely et al.

[11] 3,963,502

[45] June 15, 1976

[54] COMPOSITION FOR APPLICATION TO DIE CAVITY SURFACE

[75] Inventors: Alexander S. Borbely; Jon A. Bereman, both of Indianapolis, Ind.

[73] Assignee: P. R. Mallory & Co., Inc., Indianapolis, Ind.

[22] Filed: Sept. 27, 1974

[21] Appl. No.: 509,811

Related U.S. Application Data

[62] Division of Ser. No. 328,924, Feb. 2, 1973, Pat. No. 3,865,608.

[52] U.S. Cl. ..... 106/38.28; 106/38.22; 106/38.27; 164/33; 164/72; 252/30; 427/135

[51] Int. Cl.[2] ..... B28B 7/36

[58] Field of Search ..... 164/33, 72; 106/38.22, 106/38.23, 38.24, 38.25, 38.27, 38.28; 117/5.3, 160 A; 252/22, 23, 30; 427/135

[56] References Cited

UNITED STATES PATENTS

| | | | |
|---|---|---|---|
| 1,901,409 | 3/1933 | Poe | 106/38.28 |
| 2,157,155 | 5/1939 | Woril et al. | 117/160 A |
| 3,773,549 | 11/1973 | Elbert et al. | 106/38.27 |

FOREIGN PATENTS OR APPLICATIONS

| | | | |
|---|---|---|---|
| 926,146 | 5/1963 | United Kingdom | 106/38.28 |

*Primary Examiner*—Lorenzo B. Hayes
*Attorney, Agent, or Firm*—Hoffmann Meyer & Hanson

[57] ABSTRACT

A surface, such as a die casting cavity surface, is coated with a substantially continuous thin film including a metal oxide of tungsten or molybdenum or mixtures thereof and carbon in the amorphous or crystalline allotropic form. A composition used in a method to provide the coating over the surface includes the carbon in the amorphous or crystalline allotropic form suspended in a liquid including water and the metal oxide or acid of tungsten or molybdenum or mixtures thereof dissolved in a hydroide. The method of coating the surface includes the steps of providing the surface to be coated with an oxide film, applying the composition over the oxide film, and treating the applied composition to form the substantially continuous thin film including the metal oxide of tungsten or molybdenum or mixtures thereof and the carbon in the amorphous or crystalline allotropic form. The thin film is capable of causing modification of selected properties of the surface related to shaping of metal containing materials.

6 Claims, 3 Drawing Figures

COMPOSITION FOR APPLICATION TO DIE CAVITY SURFACE

Figure 1:
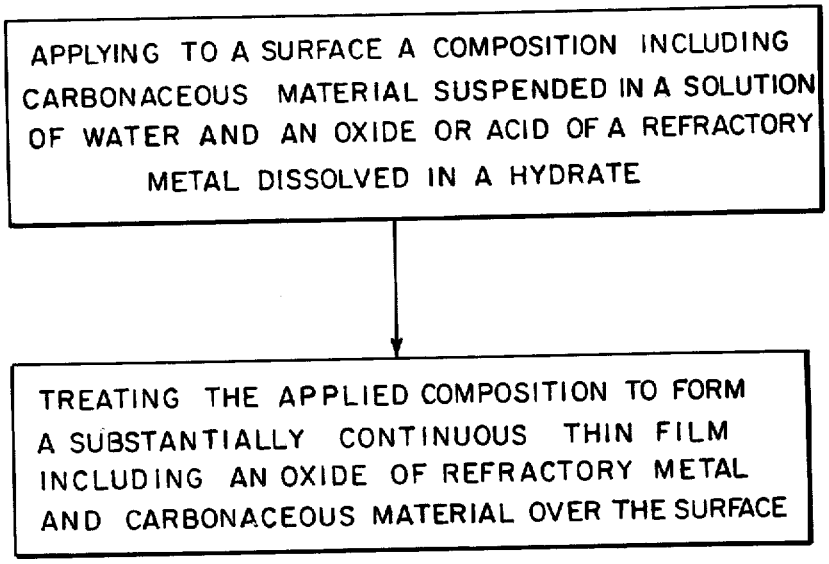

This is a division of application Ser. No. 328,924 filed 2/2/73, now U.S. Pat. No. 3,865,608.

The present invention relates to a composition for application to a surface used to form metals, to the method of applying the composition to the surface, and to a substantially continuous thin film that is the product of the method. The thin film is capable of causing modification of selected properties of the surface related to shaping of metal containing materials. More particularly, the composition includes carbon in the amorphous or crystalline allotropic form suspended in a liquid including water and a metal oxide or acid of tungsten or molybdenum or mixtures thereof dissolved in a hydroxide. The method of applying the composition to the surface includes the steps of providing the surface to be coated with an oxide film, applying the composition over the oxide film on the surface to be coated, and treating the applied composition to form a substantially continuous thin film including a metal oxide of tungsten or molybdenum or mixtures thereof and carbon. The thin film includes the metal oxide of tungsten or molybdenum or mixtures thereof and carbon in the amorphous or crystalline allotropic form.

Lubricants for application to a surface or cavity of a die used to cast metals such as aluminum have been known for years. Functions of the lubricant are to provide the die cavity with a thin film that aids in the ejection of a casting from the cavity by reducing the tendency of the cast to solder to the surface of the die cavity and helps to keep mechanical erosion of the surface of the die cavity to a minimum.

In the past oil and grease lubricants for die cavities have been widely used. To improve the releasing or ejecting power of the oil and grease lubricants, graphite is added. However, lubricants containing graphite tend to stain and discolor some castings. Where staining and discoloration of a casting is a problem, aluminum powder is added to the lubricant. However, aluminum tends to cling to the surface of some castings and build-up on the surface of the die cavity.

The more widely presently used die cavity lubricants are typically divided into two general classes. These classes are solvent base lubricants and water base lubricants. The solvent base lubricants include pigmented solvent base lubricants and non-pigmented solvent base lubricants. Typical pigmented solvent base lubricants are of very high molecular weight petroleum residue oils or wax or fats or synthetic fats with powdered solids such as aluminum, graphite or mica and a solvent carrier of low molecular weight such as diesel fuel, kerosene and the like. Typical non-pigmented solvent base lubricants are of oil with synthetic polymers of giant molecular weight and a solvent such as diesel fuel, kerosene and the like. The water base lubricants have some wetting and spreading problems and are generally considered to be inferior in such properties to the solvent base lubricants. However, the water base lubricants have obvious safety factor and air pollution advantages over some solvent base lubricants. If the water is properly treated for removal of minerals, contamination of the cavity surface by carbon and other minerals is minimized.

The use of a tungsten base or molybdenum base die for casting aluminum tends to result in oxidation of the refractory metal and soldering of the aluminum casting to the die cavity even though a conventional lubricant is applied over the die cavity surface prior to casting. Oxidation of the refractory metal renders the metal susceptible to mechanical erosion by flowing molten metal. Such results are probably because the lubricant does not always provide a continuous film over the die cavity surface. Under such circumstances, the presence of molten aluminum in the die cavity establishes a condition wherein oxidation of the refractory metal occurs at the surface of the die cavity. The oxidation does not become apparent immediately but appears to occur after continued use. Oxidation of the refractory metal cavity surface has as one result the mechanical erosion of oxidized surfaces. Mechanically eroded oxidized refractory metal flakes of the die cavity surface cling to the surface of the aluminum cast part because of being washed from the die cavity surface. Washing of oxidized refractory metal material from the die cavity surface distorts the contour of the die cavity. Coating the cavity surface of the tungsten base or molybdenum base die with a conventional lubricant of the type discussed above does not appear to solve the problems of oxidization of the refractory metal and mechanical erosion of the die cavity surface. Among other things, the conventional lubricant appears to have a discontinuous surface which allows molten metal to contact the metal surface of the die cavity. At points where the molten metal contacts the metal of the cavity surface, that is, where the conventional lubricant does not completely cover the surface of the cavity of the die, there is a tendency for that point of the surface to be subjected to conditions which appear to cause oxidation of the refractory metal ultimately resulting in mechanical erosion of the refractory metal; and there is a tendency for the molten metal to solder to the die surface at such points which impedes the removal of the cast metal from the die cavity.

In casting aluminum in a die cavity having a surface of tungsten-molybdenum-nickel-iron or molybdenum-titanium-zirconium, oxidation of the refractory metal constituent by molten aluminum or soldering of molten aluminum to the cavity of the die is minimized by providing the cavity with a thin substantially continuous film including a metal oxide of tungsten or molybdenum or mixtures thereof and carbon in the amorphous or crystalline allotropic form. The presently preferred thickness of the film over the die cavity surface of tungsten-molybdenum-nickel-iron is about 5 microns thick. The presently preferred film is substantially continuous and consists essentially of an oxide of tungsten ($WO_3$) and graphite. A preferred lubricant applied over the oxide of tungsten and graphite film is a pigmented solvent base material such as graphite and wax. It is to be understood that the use of the substantially thin film of the present invention is not a substitute for the conventional casting lubricant but is to be used in addition to such conventional lubricant.

A feature of the present invention is to provide a refractory metal base die cavity for forming metal such as casting molten aluminum with a covering of a thin substantially continuous film including a metal oxide of tungsten or molybdenum or mixtures thereof and carbon in the amorphous or crystalline allotropic form. Another feature of the invention is a method of providing the die cavity with such a film. The method includes the steps of providing the surface of the die cavity with an oxide film, and treating a composition applied to the surface to form the substantially continuous film. A further feature of the invention is the composition adapted to be applied to the surface of the die cavity which consists essentially of carbon in the amorphous or crystalline allotropic form suspended in a liquid including water and a metal oxide or acid of tungsten or molybdenum or mixtures thereof dissolved in a hydroxide.

Figure 2:
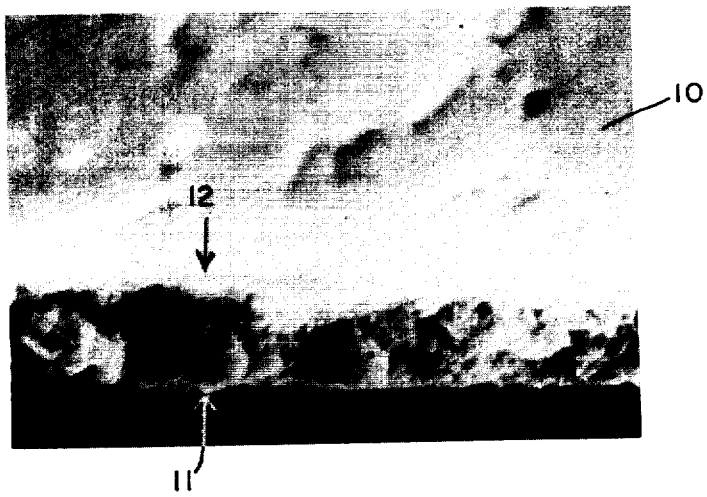

In the drawing:

FIG. 1 illustrates the steps of providing a surface with a film of the present invention; and FIG. 2 is a photomicrograph of the film of the present invention over the surface.

Referring now to FIG. 1 of the drawing, a carbonaceous material of carbon in the crystalline allotropic form, such as colloidal graphite, or carbon in the amorphous form, such as lampblack, is suspended in a liquid such as water. It is presently preferred that the carbonaceous material be colloidal graphite. An oxide of tungsten ($WO_3$) or molybdenum ($MoO_3$) or mixtures thereof or acids of such refractory metals ($H_2WO_4$, $H_2MoO_4$) is dissolved in a liquid hydroxide such as ammonium hydroxide ($NH_4OH$), sodium hydroxide (NaOH), potassium hydroxide (KOH) and the like. The presently preferred oxide is tungsten oxide ($WO_3$), the presently preferred acid is tungstic acid ($H_2WO_4$), and the presently preferred hydroxide for dissolving such oxides or acids is ammonium hydroxide ($NH_4OH$). It should be understood that acids of the metal oxides such as tungstic acid ($H_2WO_4$) can be substituted for tungsten oxide ($WO_3$) as long as the acid of such refractory metal is capable of being dissolved in the hydroxide. The water containing the suspended carbonaceous material (colloidal graphite) is blended with the solution of dissolved metal oxide ($WO_3$) or acid ($H_2WO_4$) in the hydroxide ($NH_4OH$) to provide a composition of matter for application to the surface of the die cavity.

Generally speaking, the composition can include a carbonaceous material such as carbon in the amorphous or crystalline allotropic form suspended in a solution of water and an oxide or acid of a refractory metal or mixtures thereof dissolved in a hydroxide. The presently preferred composition consists essentially of collodial graphite suspended in a solution of water and an oxide of tungsten ($WO_3$) or tungstic acid ($H_2WO_4$) dissolved in ammonium hydroxide ($NH_4OH$).

A composition consisting essentially of colloidal graphite suspended in a solution of water and oxide of tungsten ($WO_3$) dissolved in ammonium hydroxide includes 10 to 50 wt.% colloidal graphite, 5 to 40 wt.% ammonium hydroxide, 2 to 15 wt.% of the oxide of tungsten, and 70 to 30 wt.% water. It is to be understood that liquid hydroxide is to be present in quantities sufficient to dissolve the refractory metal oxide present in the composition. The presently preferred composition consists essentially of 20 to 30 wt.% colloidal graphite, 15 to 25 wt.% ammonium hydroxide, 1 to 10 wt.% of an oxide of tungsten and 60 to 40 wt.% water. The presently most preferred composition consists essentially of 24 wt.% colloidal graphite, 18 wt.% ammonium hydroxide, and 2 wt.% of an oxide of tungsten, the balance water. A preferred composition including tungstic acid ($H_2WO_4$-solid) consists essentially of 20 to 30 wt.% colloidal graphite, 15 to 25 wt.% ammonium hydroxide, 0.5 to 2 wt.% tungstic acid, the balance water.

Prior to applying the composition to a surface such as the surface of the cavity of a die including a refractory metal, the surface of the die cavity is provided with an oxide film such as by oxidizing the refractory metal in an oxidizing atmosphere. For example, the surface of a die cavity of 90 wt.% tungsten, 4 wt.% Ni,4 wt.% Mo and 2 wt.% Fe is heated in air to 700°–800°C, preferably 750°C, for a period of time sufficient to oxidize the refractory metal (W) at the surface of the cavity to a depth that is about 5 microns. It is presently believed that providing the surface of the cavity with a thin refractory metal oxide is better than providing the surface with a thick refractory metal oxide. Preferably, the hot, oxidized surface is immersed in a bath of the composition at about room temperature. It is preferred that the oxidized surface of the cavity be immersed in the bath of the composition while the surface is at a temperature of 600°C or higher. The surface should remain immersed in the bath of the composition until the composition ceases to boil. The surface is removed from the bath and reheated to a temperature for a sufficient length of time to remove residual hydroxide and water, generally to a temperature of 350°C to 400°C for several minutes. The coated surface is air cooled, cleaned and inspected.

90 wt.% tungsten 4 wt.% molybdenum, 4 wt.% nickel, 2 wt.% iron surfaces with a 5 micron thick coating consisting essentially of colloidal graphite and tungsten oxide immersed in molten aluminum at about 675°C for 24 hours exhibits a weight change of about 0.0237 wt.%. 90 wt.% tungsten, 4 wt.% molybdenum, 4 wt.% nickel, 2 wt.% iron surfaces without such a coating immersed in molten aluminum at about 675°C for 24 hours exhibits a weight change of about 0.124 wt.%.

The following Examples serve to further illustrate the invention.

EXAMPLE I

A surface of 90 wt.% W, 4 wt.% Mo, 4 wt.% Fe, and 2 wt.% Fe is heated to 750°C in an oxidizing atmosphere for a sufficient length of time to form a tungsten oxide film about 3 to 5 microns thick over the surface. The surface is immersed in a liquid composition of 24 wt.% colloidal graphite suspended in a solution of 18 wt.% ammonium hydroxide, 2 wt.% tungsten oxide ($WO_3$) and 56 wt.% water. The surface remains in the composition until boiling of the composition ceases. The surface is removed from the bath and excess water and ammonium hydroxide are removed by any suitable means such as by heating to 350°C to 400°C. The surface is inspected and a suitable lubricant for casting of aluminum is applied. Suitable lubricants include a colloidal graphite solution in water, oil or kerosene such as D-6 KG Super (a wax base graphite suspension with water) made by the Chemtrend Co. of Howell, Mich.

FIG. 2 illustrates a 90 wt.% W, 4 wt.% Mo, 4 wt.% Ni, and 2 wt.% Fe material 10 with a 5 micron thick coating 11 of colloidal graphite-tungsten oxide ($WO_3$) prepared using the method of Example 1. A suitable lubricant has not yet been applied over coating 11. Note the continuity at the interface 12 between the surface of material 10 and the coating 11.

EXAMPLE II

A surface of 90 wt.% W, 4 wt.% Mo, 4 wt.% Fe, and 2 wt.% Fe is heated to 750°C in an oxidizing atmosphere for a sufficient length of time to form a tungsten oxide film about 3 to 5 microns thick over the surface.

The surface is immersed in a liquid composition of 24 wt.% colloidal graphite suspended in a solution of 18 wt.% ammonium hydroxide, 2 wt.% tungstic acid ($H_2WO_4$-solid) and 56 wt.% water. The surface remains in the composition until boiling of the composition ceases. The surface is removed from the bath and excess water and ammonium hydroxide are removed by any suitable means such as by heating to 350°C to 400°C. The surface is inspected and a suitable lubricant for casting of aluminum is applied. Suitable lubricants include a colloidal graphite solution in water or kerosene.

The presence of small amounts of impurity elements in the composition and/or in the film of graphite and the oxide of the refractory metal are not believed to play a critical role in the invention. It should be understood, however, that it is contemplated that other elements can be present in the composition and the film of graphite and the oxide of the refractory metal, and such practices are considered within the parameters of the invention herein defined.

While the invention is described in presently preferred embodiments, it will be understood that modifications and variations may be effected without departing from the scope of the novel concepts of the invention.

We claim:

1. A composition including carbon material suspended in a solution of water and an oxide or acid of a refractory metal dissolved in a hydroxide.

2. The composition of claim 1, wherein carbon material is in an amorphous or crystalline allotropic form and the oxide or acid of tungsten or molybdenum.

3. The composition of claim 1, wherein the carbon material is graphite, the oxide of the refractory metal is an oxide of tungsten and the hydroxide in which the oxide of tungsten is dissolved is selected from ammonium hydroxide, sodium hydroxide, and potassium hydroxide.

4. The composition of claim 3, wherein the composition consits essentially of 10 to 50 wt.% graphite, 5 to 40 wt.% ammonium hydroxide, 2 to 15 wt.% tungsten oxide, and 70 to 30 wt.% water.

5. The composition of claim 3, consisting essentially of 20 to 30 wt.%, preferably 24 wt.% graphite, 15 to 25 wt.%, preferably 18 wt.%, ammonium hydroxide, 1 to 10 wt.%, preferably 2%, tungsten oxide, and 60 to 10 wt.%, preferably 56 wt.% water.

6. The composition of claim 2, consisting essentially of 20 to 30 wt.% graphite, 15 to 25 wt.% ammonium hydroxide, 0.5 to 2 wt.% tungstic acid, the balance water.

* * * * *

UNITED STATES PATENT AND TRADEMARK OFFICE

CERTIFICATE OF CORRECTION

PATENT NO. : 3,963,502

DATED : June 15, 1976

INVENTOR(S) : Alexander S. Borbely & Jon A. Bereman

It is certified that error appears in the above-identified patent and that said Letters Patent are hereby corrected as shown below:

In the Abstract: line 10, delete "hydroide" and insert ---hydroxide ---.

Signed and Sealed this

Nineteenth Day of October 1976

[SEAL]

*Attest:*

RUTH C. MASON
*Attesting Officer*

C. MARSHALL DANN
*Commissioner of Patents and Trademarks*